US008342980B2

(12) United States Patent
Jertson

(10) Patent No.: US 8,342,980 B2
(45) Date of Patent: Jan. 1, 2013

(54) GOLF CLUB HEADS WITH LOFT-BASED WEIGHTS AND METHODS TO MANUFACTURE GOLF CLUB HEADS

(75) Inventor: Marty R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 12/822,858

(22) Filed: Jun. 24, 2010

(65) Prior Publication Data

US 2010/0261541 A1 Oct. 14, 2010

Related U.S. Application Data

(62) Division of application No. 12/178,795, filed on Jul. 24, 2008, now abandoned.

(51) Int. Cl.
*A63B 53/04* (2006.01)

(52) U.S. Cl. ..... 473/291; 473/345; 473/349

(58) Field of Classification Search ..... 473/291–290, 473/287, 345–346, 349
See application file for complete search history.

(56) References Cited

U.S. PATENT DOCUMENTS

| | | | | |
|---|---|---|---|---|
| 3,980,301 | A * | 9/1976 | Smith | 473/314 |
| 4,840,380 | A * | 6/1989 | Kajita et al. | 473/291 |
| 5,908,356 | A * | 6/1999 | Nagamoto | 473/224 |
| 6,074,310 | A * | 6/2000 | Ota | 473/345 |
| 6,494,790 | B1 * | 12/2002 | Toyota et al. | 473/345 |
| 6,599,202 | B2 * | 7/2003 | Miyamoto | 473/289 |
| 6,852,038 | B2 * | 2/2005 | Yabu | 473/224 |
| 6,945,877 | B2 * | 9/2005 | Kobayashi et al. | 473/345 |
| 7,153,220 | B2 * | 12/2006 | Lo | 473/335 |
| 7,556,571 | B2 * | 7/2009 | Adams | 473/342 |
| 7,887,434 | B2 * | 2/2011 | Beach et al. | 473/334 |
| 7,938,736 | B2 * | 5/2011 | Park et al. | 473/290 |
| 2002/0055391 | A1 | 5/2002 | Teramoto | |
| 2007/0049405 | A1 * | 3/2007 | Tateno et al. | 473/345 |
| 2007/0117651 | A1 * | 5/2007 | Belmont | 473/349 |
| 2008/0058113 | A1 * | 3/2008 | Nicolette et al. | 473/290 |
| 2008/0132356 | A1 * | 6/2008 | Chao et al. | 473/350 |
| 2008/0161124 | A1 * | 7/2008 | Kajita | 473/330 |

FOREIGN PATENT DOCUMENTS

| | | | |
|---|---|---|---|
| JP | 2000300701 | A | 4/1999 |
| JP | 2000300701 | A * | 10/2000 |

* cited by examiner

*Primary Examiner* — Stephen L. Blau

(57) ABSTRACT

Embodiments of golf club heads with loft-based weights and methods to manufacture golf club heads are generally described herein. Other embodiments may be described and claimed.

24 Claims, 7 Drawing Sheets

GOLF CLUB HEADS WITH LOFT-BASED WEIGHTS AND METHODS TO MANUFACTURE GOLF CLUB HEADS

CROSS-REFERENCE TO RELATED APPLICATIONS

This application is a divisional application of U.S. patent application Ser. No. 12/178,795, filed Jul. 24, 2008 now abandoned.

TECHNICAL FIELD

The present disclosure relates generally to golf equipment, and more particularly, to golf club heads with loft-based weights and methods to manufacture golf club heads.

BACKGROUND

Typically during a golf shot, energy may be transferred from the club head of a golf club to the golf ball. Several factors including initial velocity, backspin rate, and launch angle may affect the flight of the golf ball (i.e., ball flight). In addition to club head speed, club head shape and structure may affect the initial velocity, the spin rate, and/or the launch angle of the golf ball. The initial velocity of the golf ball may be a function of the club head speed at impact between the club head and the golf ball. With all other factors held constant, a higher initial ball velocity may result in the golf ball traveling farther.

The physical geometry and structure of the club head may define a loft angle (e.g., club loft). In particular, the loft angle may be an angle between a front end plane and a loft plane (e.g., a plane parallel to the club face). When the club head impacts the golf ball, spin may be imparted on the golf ball. Ball flight and flight distance of the golf ball may vary based on the spin imparted by the club head. For example, a club head with a relatively higher loft angle may impart a relatively higher ball flight but may provide a relatively shorter flight distance. In contrast, a club head with a relatively lower loft angle may provide a relatively farther flight distance but impart a relatively lower ball flight. Thus, a set of golf clubs may include a progression of loft angles to provide an individual with a range of ball flights and flight distances.

DESCRIPTION

In general, apparatus, methods, and articles of manufacture associated with golf club heads with loft-based weights are described herein. The methods, apparatus, and articles of manufacture described herein are not limited in this regard.

Figure 1:
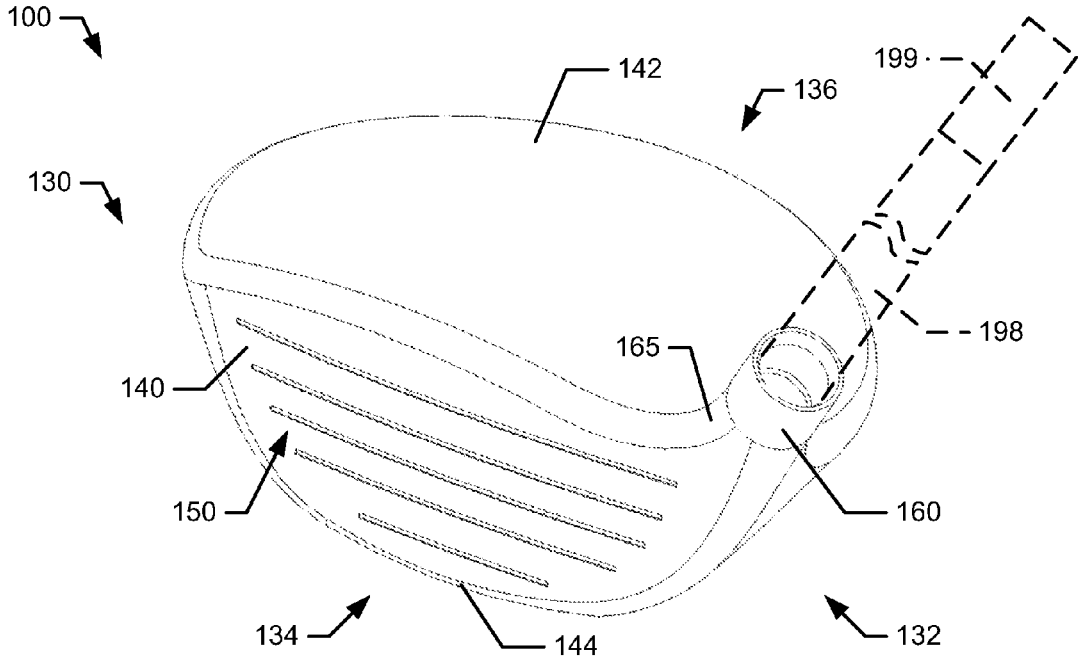
FIG. 1 is a top perspective view of an example golf club head according to an embodiment of the apparatus, methods, and articles of manufacture described herein.
Figure 2:
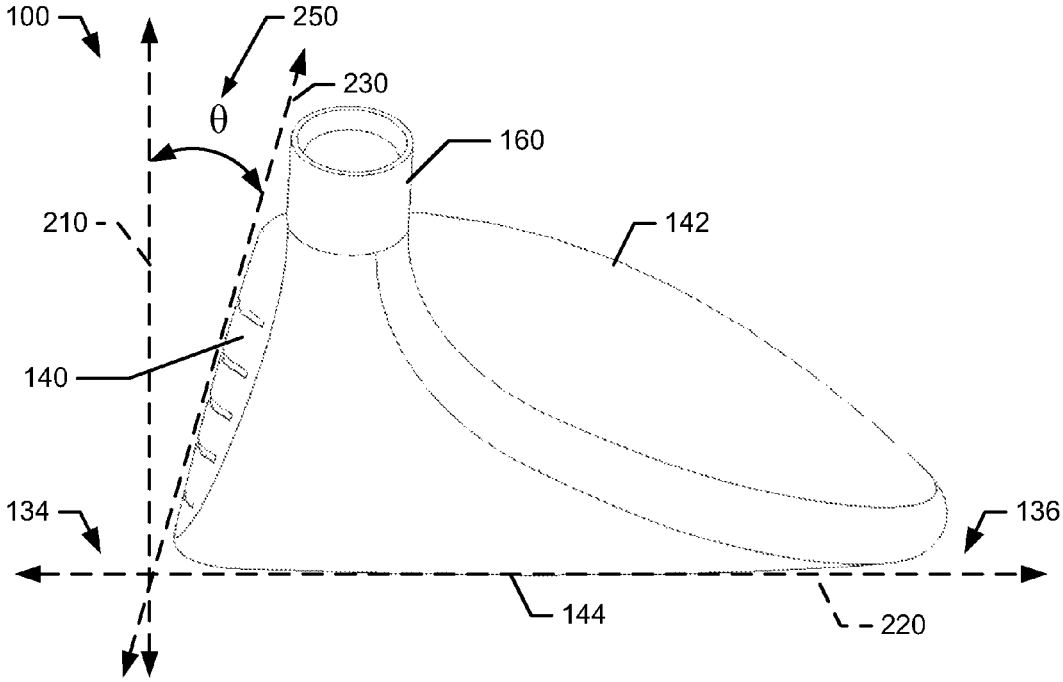
FIG. 2 depicts a heel end view of the example golf club head of FIG. 1.

FIGS. 1 and 2 depict an example golf club head 100 that may include a toe end 130, a heel end 132, a front end 134, a back end 136, a face portion 140, a top wall portion 142 (e.g., a crown), and a bottom wall portion 144 (e.g., a sole). The golf club head 100 may be made of one or more metal materials such as titanium, titanium alloy, and/or any other suitable materials.

The toe end 130 may be opposite of the heel end 132, and the front end 134 may be opposite of the back end 136. The face portion 140 may be located in the front end 134 and configured to impact a golf ball (not shown). In particular, the face portion 140 may include a plurality of grooves 150. The plurality of grooves 150 may be elongated in a direction between the toe end 130 and the heel end 132 on the face portion 140. The top wall portion 142 may be opposite of the bottom wall portion 144.

The golf club head 100 may also include a hosel 160 and a hosel transition 165. For example, the hosel 160 may be located at or proximate to the heel end 132. The hosel 160 may extend from the club head 100 via the hosel transition 165. To form a golf club, the hosel 160 may receive a first end of a shaft 198. The shaft 198 may be secured to the golf club head 100 by an adhesive bonding process (e.g., epoxy) and/or other suitable bonding processes (e.g., mechanical bonding, soldering, welding, and/or brazing). Further, a grip 199 may be secured to a second end of the shaft 198 to complete the golf club.

While the above examples describe various portions and/or surfaces of the golf club head 100, the golf club head 100 may not include certain portions and/or surfaces. For example, although one or more figures may depict the top wall portion 142 transitioning directly to the bottom wall portion 144, the golf club head 100 may include a separate side wall portion (e.g., a skirt). In particular, the side wall portion may be located between the top wall portion 142 and the bottom wall portion 144, and wrap around the back end 136 of the golf club head 100 from the toe end 130 to the heel end 132. Further, while one or more of figures may depict the hosel 160 and the hosel transition 165, the golf club head 100 may not include the hosel 160 and/or the hosel transition 165. In one example, the club head 100 may include a bore (not shown) within the golf club head 100 to receive a shaft (e.g., an opening of the bore may be relatively flushed with the top wall portion 142).

Referring to FIG. 2, for example, the golf club head 100 may be associated with a front end plane 210, a ground plane 220, and a loft plane 230. The front end plane 210 may be perpendicular to the ground plane 220. The ground plane 220 may be substantially parallel to the bottom wall portion 144 of the golf club head 100. The loft plane 230 may be substantially parallel to the face portion 140 of the golf club head 100 and may intersect with the ground plane 220 at the intersection line 235. The front end plane 210 and the loft plane 230 may form a loft angle 250 ($\theta$).

As noted above, spin may be imparted on a golf ball (not shown) when the golf club head 100 impacts the golf ball. Ball flight and flight distance of the golf ball may vary based on the spin imparted by the golf club head 100. For example, a golf club head with a relatively higher loft angle may impart a relatively higher ball flight but may provide a relatively shorter flight distance. In contrast, a golf club head with a relatively lower loft angle may provide a relatively farther flight distance but impart a relatively lower ball flight. Thus, a set of golf clubs may include a progression of loft angles to provide an individual with a range of ball flights and flight distances. Instead of manufacturing a weight at an identical position in golf club heads with various loft angles, an internal and/or external weight (not shown) may be positioned based on the loft angle 250 as described in detail below. The methods, apparatus, and articles of manufacture described herein are not limited this regard.

In the examples of FIGS. 3-10, each of a first golf club head 300 (e.g., shown in FIGS. 3, 5, 7, and 9) and a second golf club head 400 (e.g., shown in FIGS. 4, 6, 8, and 10) may include a weight, generally shown as a first weight (e.g., 710 of FIG. 7) and a second weight (e.g., 810 of FIG. 8), respectively. As described in detail below, each of the first weight 710 (FIG. 7) and the second weight 810 (FIG. 8) may be associated with a particular weight position based on a loft angle. Although the first and second weights 710 and 810 may be depicted as internal weights (e.g., within the first and second golf club heads 300 and 400 respectively), the first and second weights 710 and 810 may be external weights. Alternatively, the first and second weights 710 and 810 may include an internal portion and an external portion relative to the first and second golf club heads 300 and 400, respectively.

Figure 3:
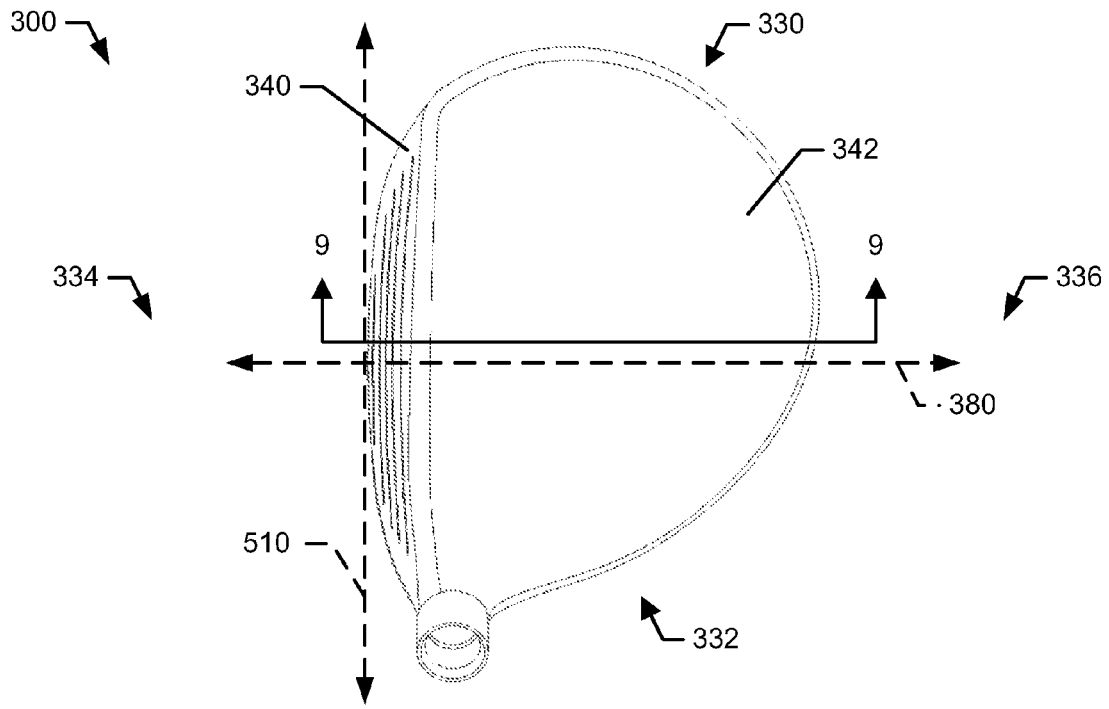
FIG. 3 depicts a top view of an example golf club head.
Figure 5:
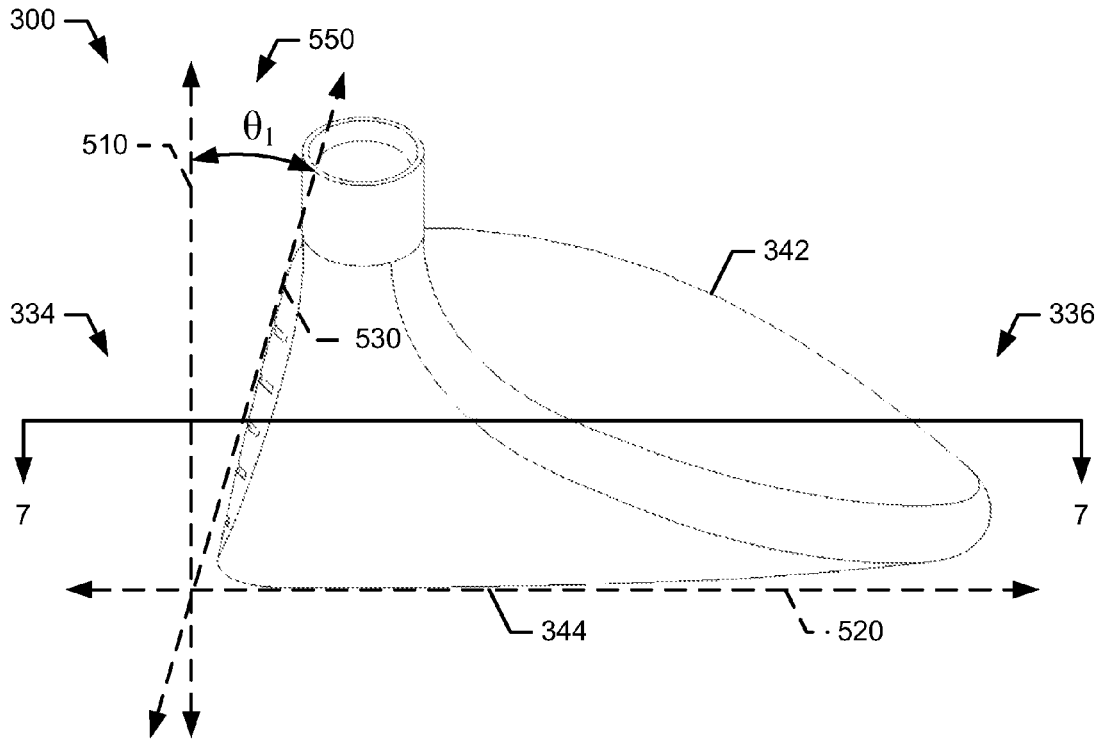
FIG. 5 depicts a heel end view of the example golf club head of FIG. 3.
Figure 7:
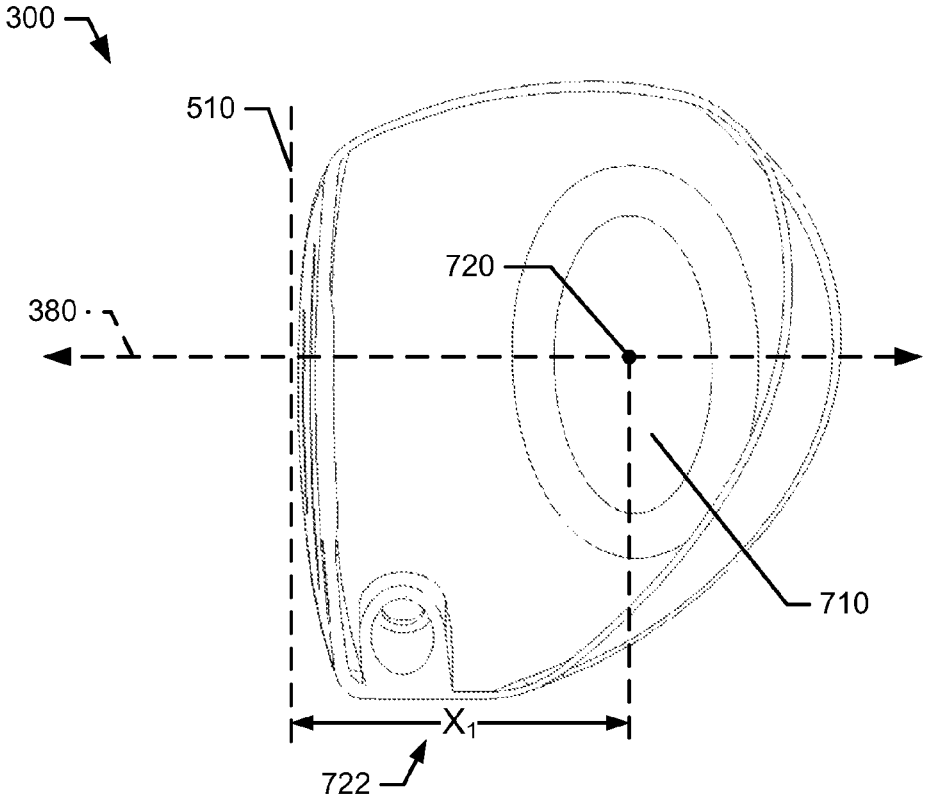
FIG. 7 depicts a cross-sectional view of the example golf club head of FIG. 3 along the line 7-7.

As illustrated in FIGS. 3, 5, 7, and/or 9, the first golf club head 300 may include a first toe end 330, a first heel end 332, a first front end 334, a first back end 336, a first face portion 340, a first top wall portion 342, and a first bottom wall portion 344. For example, the first golf club head 300 may be associated with a first front end plane 510, a first ground plane 520, and a first loft plane 530. Similar to the front end plane 210 and the ground plane 220 as described above and shown in FIG. 2, the first front end plane 510 may be perpendicular to the first ground plane 520. The first ground plane 520 may be substantially parallel to the first bottom wall portion 344 of the first golf club head 300. The first front end plane 510 and the first ground plane 520 may be perpendicular to each other and intersect at a first intersection line 535. The first loft plane 530 may be substantially parallel to the first face portion 340 of the first golf club head 300. The first loft plane 530 may also intersect with the first ground plane 520 at the first intersection line 535. The first front end plane 510 and the first loft plane 530 may form a first loft angle 550 ($\theta_1$).

The first front end plane 510 may intersect a first axis 380 (FIGS. 3 and 7) extending from the first front end 334 to the first back end 336 of the first club head 300. In one example, the first axis 380 may be centered relative to the first face portion 340 of the first club head 300. In another example, the first axis 380 may be positioned toward the first heel end 332 or the first toe end 330 of the first golf club head 300. In addition or alternatively, the first axis 380 may be position toward the first top wall portion 342 or the first bottom wall portion 344.

Figure 4:
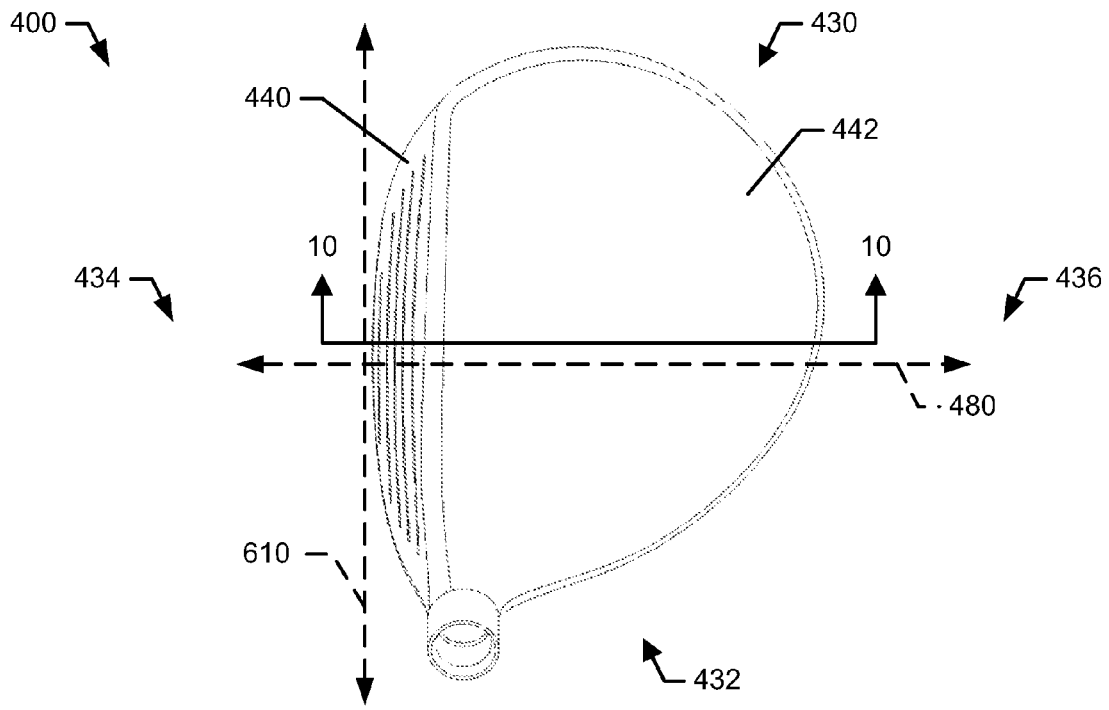
FIG. 4 depicts a top view of another example golf club head.
Figure 6:
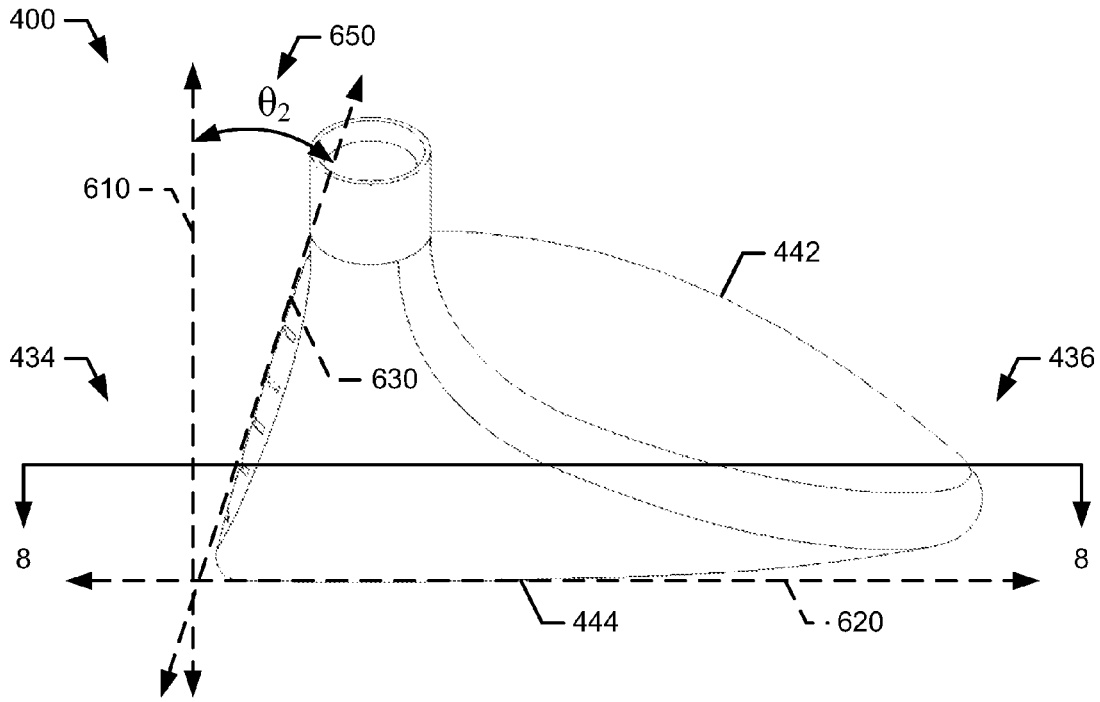
FIG. 6 depicts a heel end view of the example golf club head of FIG. 4.
Figure 8:
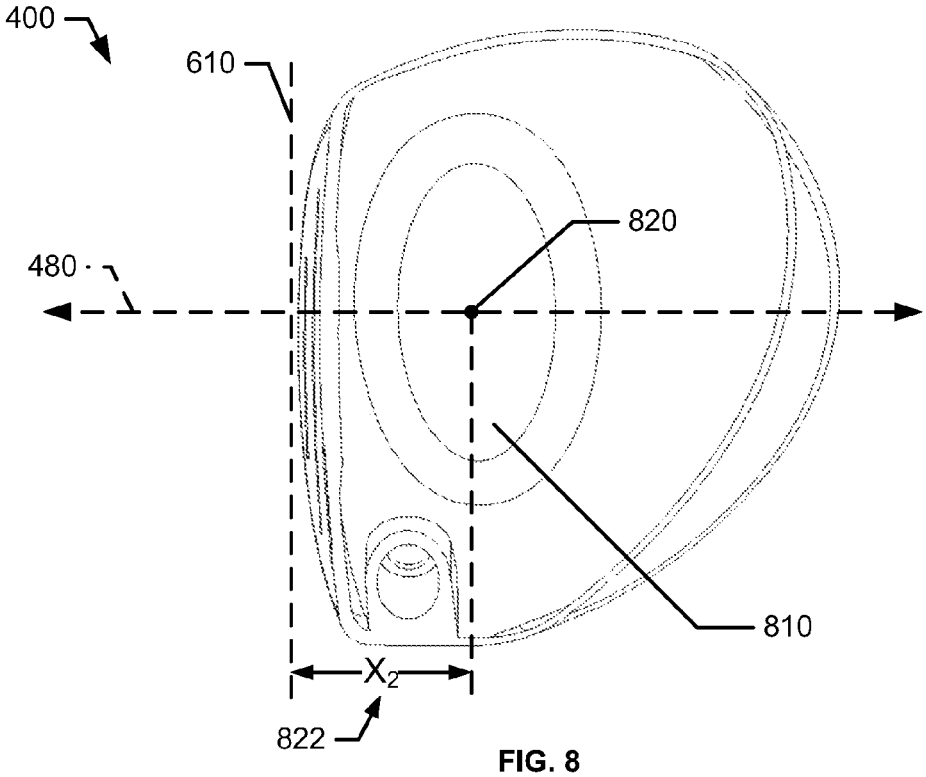
FIG. 8 depicts a cross-sectional view of the example golf club head of FIG. 4 along the line 8-8.
Figure 9:
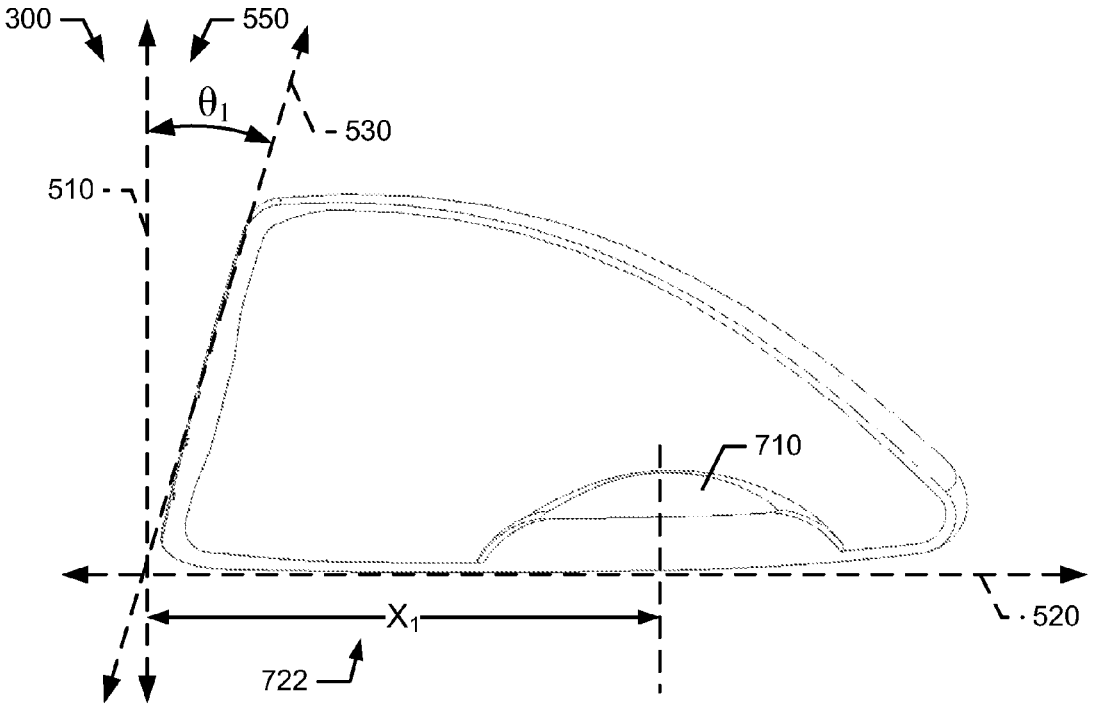
FIG. 9 depicts a cross-sectional view of the example golf club head of FIG. 5 along the line 9-9.

In a similar manner as depicted in FIGS. 4, 6, 8, and/or 10, a second golf club head 400 may include a second toe end 430, a second heel end 432, a second front end 434, a second back end 436, a second face portion 440, a second top wall portion 442, and a second bottom wall portion 444. For example, the second golf club head 400 may be associated with a second front end plane 610, a second ground plane 620, and a second loft plane 630. Similar to the first front end plane 510 and the first ground plane 520 as described above (FIG. 5), the second front end plane 610 and the second ground plane 620 may be perpendicular to each other and intersect at a second intersection line 635. The second ground plane 620 may be substantially parallel to the second bottom wall portion 644 of the second golf club head 400. The second loft plane 630 may be substantially parallel to the second face portion 640 of the second golf club head 400. The second loft plane 630 may also intersect with the second ground plane 620 at the second intersection line 635. The second front end plane 610 and the second loft plane 630 may form a second loft angle 650 ($\theta_2$).

The second front end plane 610 may intersect a second axis 480 (FIGS. 4 and 8) extending from the second front end 434 to the second back end 436 of the second club head 400. In one example, the second axis 480 may be centered relative to the second face portion 440 of the second club head 400. In another example, the second axis 480 may be positioned toward the second heel end 432 or the second toe end 430 of the second golf club head 400. In addition or alternatively, the second axis 480 may be positioned toward the second top wall portion 442 or the second bottom wall portion 444.

Figure 10:
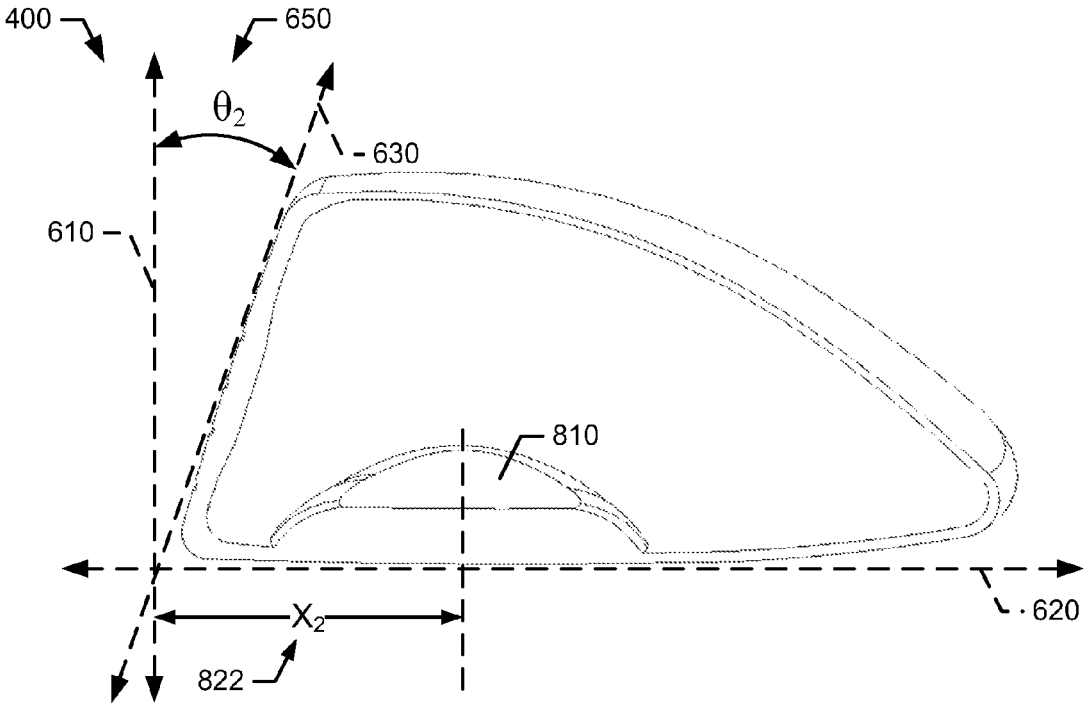
FIG. 10 depicts a cross-sectional view of the example golf club head of FIG. 6 along the line 10-10.

As noted above, the first golf club head 300 may include a first weight 710 (FIGS. 7 and 9) and the second golf club head 400 may include a second weight 810 (FIGS. 8 and 10). In particular, the first weight 710 may be associated with a first weight position 720 whereas the second weight 810 may be associated with a second weight position 820. The first weight position 720 may be located at or proximate to a distance along the first axis 380 between the first loft plane 530 and the first back end 336. The second weight position 820 may be located at or proximate to a distance along the second axis 480 between the second loft plane 630 and the second back end 436. In one example, the first weight position 720 may correspond to a location of a center of mass of the first weight 710, and the second weight position 820 may correspond to a location of a center of mass of the second weight 810. Alternatively, the first weight position 720 may be correspond to a location of an edge of the first weight 710, and the second weight position 820 may correspond to an edge of the second weight 810 (e.g., a front edge or a back edge of the weight).

The first weight position 720 may be defined by the first loft angle 550 whereas the second weight position 820 may be defined by the second loft angle 650. Further, the first weight position 720 may be located at or proximate to a first distance 722 ($X_1$) from the first front end plane 510 whereas the second weight position 820 may be located at or proximate to a second distance 822 ($X_2$) from the second front end plane 610. In general, the second loft angle 650 is greater than the first loft angle 550 ($\theta_2>\theta_1$). However, the second weight position 820 may be located relatively closer to the second front end plane 610 than the first weight position 720 relative to the first front end plane 510 ($X_1>X_2$). Accordingly, as the loft angle increases, the distance of the weight position relative to the front end plane may decrease (e.g., the weight may be positioned closer to the front end plane). Therefore, the distance of the weight position relative to the front end plane may be inversely proportional to the loft angle of a golf club head.

Although the figures may depict the first and second weights 710 and 810 having elliptical shapes, the first and/or second weights 710 and 810 may have circular shapes, polygonal shapes, free-formed shapes (e.g., figure-eight shapes, kidney shapes, etc.), or any other suitable shapes. While the first and second weights 710 and 810 may be depicted as having the same shape, the first and second weights 710 and 810 may have different shapes. In one example, each of the first and second weights 710 and 810 may be at least 48 grams. Also, the first and second weights 710 and 810 may be approximately 2.3 inches in length, 1.5 inches in width, and 0.3 inches in height. The first and/or second weights 710 and 810 may be a single weight or a plurality of weights with other dimensions. The first and/or second weights 710 and 810 may include metal material such as steel, titanium, titanium alloy, tungsten, and/or any other suitable materials. While the above examples may depict weights of particular size, shape, and/or material, the apparatus, methods, and articles of manufacture described herein may include weights configured in various sizes, shapes, and/or materials. The methods, apparatus, and articles of manufacture described herein are not limited in this regard.

Figure 11:
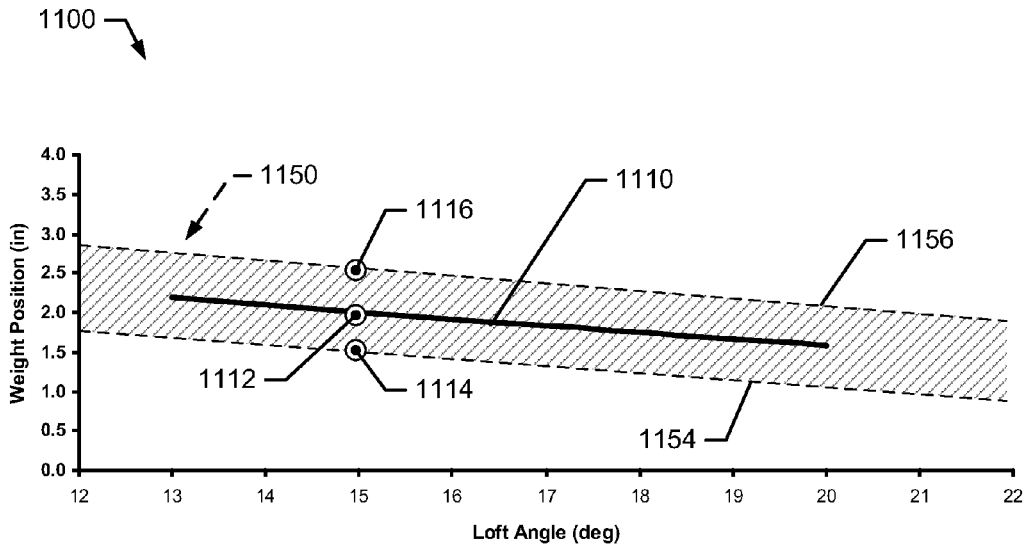
FIG. 11 depicts an example graph of weight position versus loft angle.

In general, the weight position (e.g., the first weight position 720 of FIG. 7 or the second weight position 820 of FIG. 8) may be based on the loft angle of a golf club head. The distance between the weight position and the front end plane may be a function of the loft angle in either a linear manner (e.g., FIG. 11) or a non-linear manner (e.g., FIG. 12). In the example of FIG. 11, a linear relationship 1100 between the weight position and the loft angle may be defined by the equation of $x=(-0.086*\theta)+3.297$, where x represents the distance between the weight position and the front end plane in units of inches (in), and θ represents the loft angle in units of degrees (°) (e.g., shown as line 1110). As the loft angle increases, the distance between the weight position and the front end plane decreases. For example, the equation may indicate that the weight may be positioned at or about two (2) inches from the front end plane for a golf club head with a 15-degree loft angle whereas the weight may be positioned at or about one-and-a-half (1.5) inches from the front end plane for a golf club head with a 20-degree loft angle. Further, a suitable range of weight positions for a golf club head with a 15-degree loft angle may extend between 1.5 inches (1114) to 2.5 inches (1116). Alternatively, the relationship between the weight position and the loft angle may be defined by a range. As shown in dashed lines, for example, a range of suitable weight positions 1150 may be defined by a lower boundary 1154 and an upper boundary 1156. The range of suitable weight positions 1150 may be defined by the equation $(-0.086*\theta)+3.797 \geqq x \geqq (-0.086*\theta)+2.797$. Although FIG. 11 may depict an example equation with a particular range of loft angles, the methods, apparatus, and articles of manufacture described herein are not limited in this regard.

Figure 12:
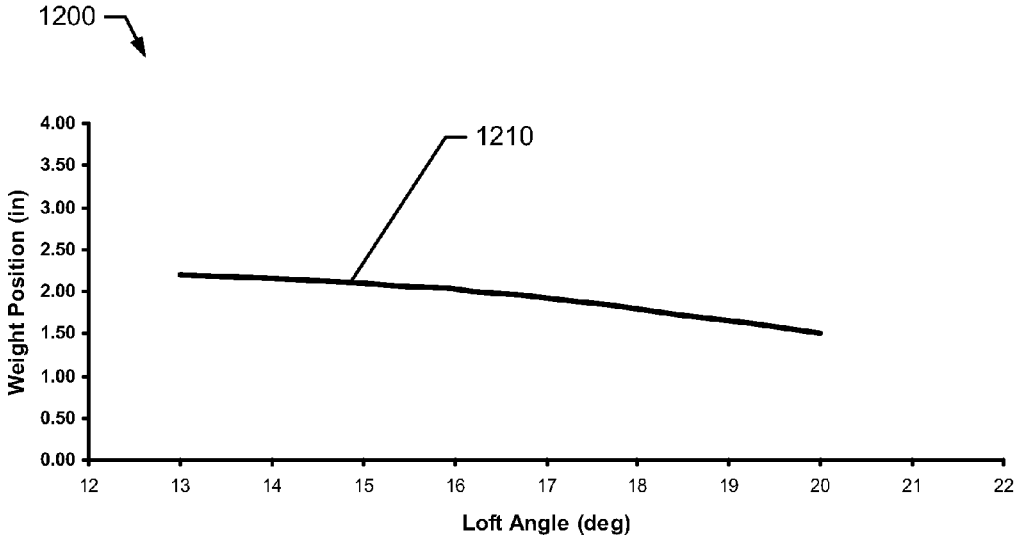
FIG. 12 depicts another example graph of weight position versus loft angle.

Alternatively, as noted above, the weight position may be inversely proportional to the loft angle in a non-linear manner. Referring to FIG. 12, for example, a non-linear relationship 1200 between the weight position and the loft angle may be defined by the equation of $x=(-0.009*\theta\hat{}2)+(0.194*\theta)+1.192$, where x represents the weight position in units of inches (in), and θ represents the loft angle in units of degrees (°) (e.g., shown as line 1210). As the loft angle increases, the distance between the weight position and the front end plane decreases. While FIG. 12 may depict an example equation with a particular range of loft angles, the methods, apparatus, and articles of manufacture described herein are not limited in this regard.

Figure 13:
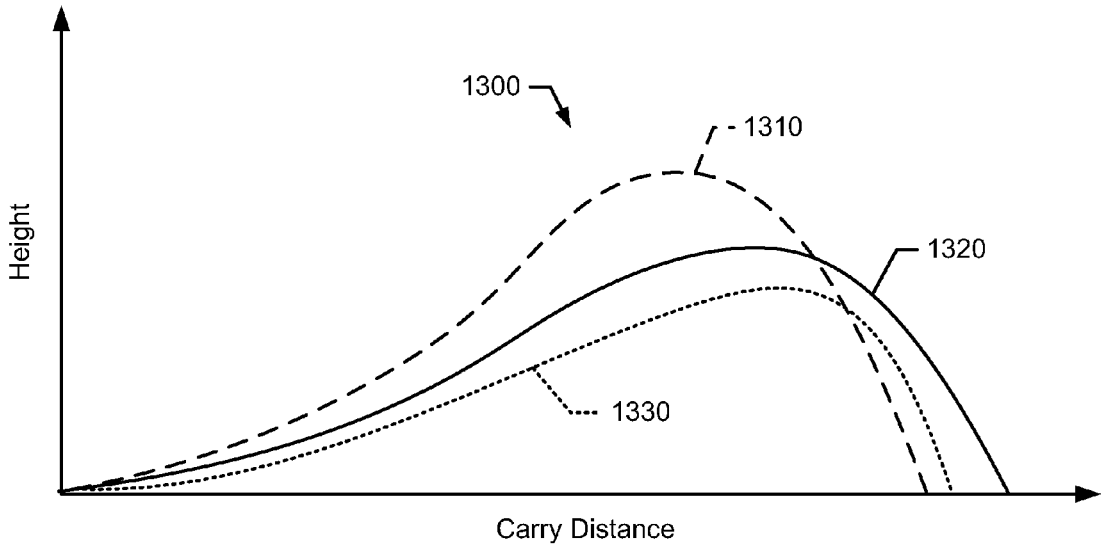
FIG. 13 depicts an example graph of ball height versus carry distance.

Turning to FIG. 13, for example, each golf shot from a golf club head may be associated with a ball flight trajectory 1300, generally shown as a first trajectory 1310, a second trajectory 1320, and a third trajectory 1330. For the examples described below, the club head speed and the loft angle associated with the all flight trajectories 1300 may be constant. In particular, the ball flight trajectories 1300 may represent the effect of weight position of a golf club head on height and carry distance of a golf ball. The ball flight trajectories 1300 may vary based on the movement of a weight along an axis that may be perpendicular to the front end plane (e.g., the axis 380 of FIG. 3 or the axis 480 of FIG. 4).

In one example, the second trajectory 1320 may represent a weight position to provide optimal spin and carry distance. In contrast, a weight position associated with the first trajectory 1310 may be farther from a front end plane than a weight position associated with the second trajectory 1320. As a result, the weight position associated with the first trajectory 1310 may generate relatively more spin resulting in relatively higher ball flight and less carry distance. In another example, a weight position associated with the third trajectory 1330 may be closer to a front end plane than a weight position associated with the second trajectory 1320. Thus, a weight position associated with the third trajectory 1330 may be generate relatively less spin resulting in relatively lower ball flight and less carry distance. The methods, apparatus, and articles of manufacture described herein are not limited in this regard.

As a result, a golf club head with a relatively lower loft angle and a weight positioned relatively farther from a front end plane may increase the amount of spin imparted on a golf ball to increase ball flight of the golf ball. A golf club head with a relatively higher loft angle and a weight position relatively closer to the front end plane may reduce the amount of spin imparted on a golf ball to increase the flight distance traveled by the golf ball. Further, the golf club head with the relatively higher loft angle and the weight position relatively closer to the front end plane may rotate relatively less than the golf club head with the relatively lower loft angle and the weight positioned relatively farther from the front end plane. With relatively less rotation at impact with the golf ball, the amount of vibration may be reduced to provide a better feel. The methods, apparatus, and articles of manufacture described herein are not limited in this regard.

Although the above examples describe various portions and/or surfaces of the golf club head 100, the golf club head 100 may not include certain portions and/or surfaces. For example, while FIG. 1 may depict the top wall portion 142, the bottom wall portion 144, and the side wall 146 as separate surfaces, the side wall 146 may merge with either the top wall portion 142 or the bottom wall portion 144 into a single surface of the hollow body 110 (e.g., the body 110 may include the top wall portion 142 and the bottom wall portion 144 but not the side wall 146). In one example, the bottom wall portion 144 and the side wall 146 may merge into a single bottom surface of the body 110. Further, although FIG. 1 may depict the hosel 160 and the hosel transition 165, the golf club head 100 may not include the hosel 160 and/or the hosel transition 165. In one example, the golf club head 100 may include a bore (not shown) within the body 110 to receive the shaft 198 (e.g., an opening of the bore may be flushed with the top wall portion 142).

While some of the above figures may depict a utility club head or a metal wood-type club head (e.g., drivers, fairway woods, etc.), the methods, apparatus, and articles of manufacture described herein may be readily applicable to other suitable types of golf club heads. For example, the methods, apparatus, and articles of manufacture described herein may be applicable to hybrid-type club heads, iron-type club heads, or other suitable types of golf club heads. The methods, apparatus, and articles of manufacture described herein are not limited this regard.

Figure 14:
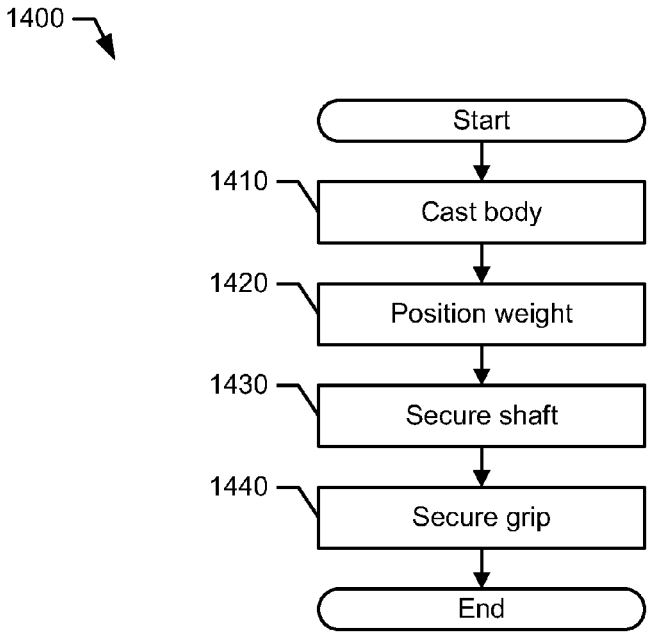
FIG. 14 is a flow diagram of one manner in which an example golf club may be manufactured.

In the example of FIG. 14, a process 1400 may begin with casting the club head 100 (FIG. 1) to form a golf club (block 1410). As noted above, the club head 100 may include the face portion 140, which may define a loft angle. The process 1400 may include positioning a weight (e.g., the weight 518 of FIG. 5) at a distance relative to a front end plane based on the loft angle (e.g., the first loft angle 510 of FIG. 5) in either a linear manner or a non-linear manner as described above (block 1420). Further, the process 1400 may include securing a shaft (e.g., the shaft 198 of FIG. 1) to the club head 100 as described above (block 1430). Further, the process 1400 may include securing a grip (e.g., the grip 199 of FIG. 1) to the shaft 198 (block 1440).

Although the process 1400 may be described above with respect to the golf club head 100, the process 1400 may be applicable to other golf club heads. Further, while a particular order of actions is illustrated in FIG. 14, these actions may be performed in other temporal sequences. For example, two or more actions depicted in FIG. 14 may be performed sequentially, concurrently, or simultaneously.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A set of golf clubs comprising:

at least two golf clubs, each club of the at least two golf clubs comprising:

a grip;

a shaft having a first end and a second end, the shaft coupled to the grip at the first end; and a club head having a toe end, a heel end, a front end, a back end, a top wall portion, a bottom wall portion, and a face portion associated with a loft angle, the loft angle defined by a loft plane and a front end plane perpendicular to a ground plane, the loft plane substantially parallel to the face portion, the front end plane located at a front-most part of the face portion; and a first weight positioned at or proximate to a first distance from the front end plane, at least a portion of the first weight positioned along an axis extending between the front end and the back end, wherein:

the first distance of each club of the at least two golf clubs is defined by an equation of $((-0.086*\theta)+3.797) \geqq x \geqq ((-0.086*\theta)+2.797)$, where the first distance, x, has units of inches and the loft angle, θ, has units of degrees; and each of the at least two golf clubs has a different loft angle and a different first distance; and either a center of mass of the first weight in each club of the at least two golf clubs or an edge of the first weight in each club of the at least two golf clubs is positioned at or proximate to the first distance.

2. The set of golf clubs of claim 1, wherein:

the first distance of each club of the at least two golf clubs is comprises:

inversely proportional to the loft angle in a linear manner; or inversely proportional to the loft angle in a non-linear manner.

3. The set of golf clubs of claim 1, wherein:

the center of mass of the first weight in each club of the at least two golf clubs is positioned at or proximate to the first distance.

4. The set of golf clubs of claim 1, wherein:

the first weight is integrated into the club head.

5. The set of golf clubs of claim 1, wherein:

the first distance of the first weight of each club head of the two or more golf clubs is inversely proportional to the loft angle.

6. The set of golf clubs of claim 1, wherein:

the first distance, x, is defined by an equation of $x=(-0.086*\theta)+3.297$, where the first distance, x, has units of inches and the loft angle, θ, has units of degrees.

7. The set of golf clubs of claim 1, wherein:

the edge of the first weight in each club of the at least two golf clubs is positioned at or proximate to the first distance.

8. A set of golf clubs comprising:

two or more golf club heads, wherein:

each club head of the two or more golf club heads comprises: a body having a front face and a first weight;

a center of mass or an edge of the first weight of each club head of the two or more golf club heads is positioned at a first distance relative to a front end plane, the front end plane is located at the front face and is perpendicular to a ground plane;

the front face of each club head of the two or more golf club heads has a loft angle, the loft angle is an angle between the front face and the front end plane;

the first distance of the first weight of each club head of the two or more golf club heads is inversely proportional to the loft angle of the front face of each club head of the two or more golf club heads in a linear manner; and each of the two or more golf club heads has a different loft angle and a different first distance, wherein:

the first distance, x, is defined by an equation of $((-0.086*\theta)+3.797) \geqq x \geqq ((-0.086*\theta)+2.797)$, where the first distance, x, has units of inches and the loft angle, θ, has units of degrees.

9. The set of golf clubs of claim 8, wherein:

the first distance, x, is defined by an equation of $x=(-0.086*\theta)+3.297$, where the first distance, x, has units of inches and the loft angle, θ, has units of degrees.

10. The set of golf clubs of claim 8, wherein the center of mass of the first weight in each club head of the two or more golf club heads is positioned at the first distance.

11. The set of golf clubs of claim 8, wherein:

the edge of the first weight in each club head of the two or more golf club heads is positioned at the first distance.

12. A set of golf clubs comprising:

a first club having a first club head, the first club head comprising: a first toe end, a first heel end, a first front end, a first back end, a first top wall portion, a first bottom wall portion, a first face portion associated with a first loft angle defined by a first loft plane and a first front end plane, the first front end plane is perpendicular to a first ground plane, and a first weight positioned at or proximate to a first distance relative to the first front end plane, at least a potion of the first weight positioned along a first axis extending between the first front end and the first back end; and a second club having a second club head, the second club head having a second toe end, a second heel end, a second front end, a second back end, a second top wall portion, a second bottom wall portion, a second face portion associated with a second loft angle defined by a second loft plane and a second front end plane, the second front end plane is perpendicular to the first ground plane, and a second weight positioned at or proximate to a second distance relative to the second front end plane, at least a portion of the second weight positioned along a second axis extending between the second front end and the second back end, wherein:

the first loft angle is greater than the second loft angle;

the first distance is less than the second distance;

the first distance is defined by a first equation of $((-0.086*\theta)+3.797) \geqq x \geqq ((-0.086*\theta)+2.797)$, where the first distance, x, has units of inches and the first loft angle, θ, has units of degrees; and the second distance is defined by a second equation of $((-0.086*\alpha)+3.797) \geqq y \geqq ((-0.086*\alpha)+2.797)$, where the second distance, y, has units of inches and the second loft angle, α, has units of degrees; and one of the following:

a center of mass of the first weight is positioned at or proximate to the first distance and a center of mass of the second weight is positioned at or proximate to the second distance; or an edge of the first weight is positioned at or proximate to the first distance and an edge of the second weight is positioned at or proximate to the second distance.

13. The set of golf clubs of claim 12, wherein:

the first distance is:

inversely proportional to the first loft angle in a linear manner; or inversely proportional to the first loft angle in a non-linear manner;

the second distance is inversely proportional to the second loft angle in the linear manner if the first distance is inversely proportional to the first loft angle in the linear manner; and the second distance is inversely proportional to the second loft angle in the non-linear manner if the first distance is inversely proportional to the first loft angle in the non-linear manner.

14. The set of golf clubs of claim 12, wherein:

the center of mass of the first weight is positioned at or proximate to the first distance; and the center of mass of the second weight is positioned at or proximate to the second distance.

15. The set of golf clubs of claim 12, wherein:

the edge of the first weight is positioned at or proximate to the first distance; and the edge of the second weight is positioned at or proximate to the second distance.

16. The set of golf clubs of claim 12, wherein:

the first distance is defined by a first equation of $x=(-0.086*\theta)+3.297$, where the first distance, x, has units of inches and the first loft angle, $\theta$, has units of degrees; and the second distance is defined by a second equation of $y=(-0.086*\alpha)+3.297$, where the second distance, y, has units of inches and the second loft angle, $\alpha$, has units of degrees.

17. The set of golf clubs of claim 16, further comprising:

a third club having a third club head, the third club head having a third toe end, a third heel end, a third front end, a third back end, a third top wall portion, a third bottom wall portion, a third face portion associated with a third loft angle defined by a third loft plane and a third front end plane, the third front end plane is perpendicular to the first ground plane, and a third weight positioned at or proximate to a third distance relative to the third front end plane, at least a portion of the third weight positioned along a third axis extending between the third front end and the third back end, wherein:

the first loft angle and the second loft angle are greater than the third loft angle;

the first distance and the second distance are less than the third distance;

the third distance is defined by a third equation of $((-0.086*\beta)+3.797)\geqq z\geqq((-0.086*\beta+2.797)$, where the third distance, z, has units of inches and the third loft angle, $\beta$, has units of degrees; and one of the following:

a center of mass of the third weight is positioned at or proximate to the third distance; or an edge of the third weight is positioned at or proximate to the third distance.

18. The set of golf clubs of claim 17, wherein:

the third distance is defined by a third equation of $z=(-0.086*\beta)+3.297$, where the third distance, z, has units of inches and the third loft angle, $\beta$, has units of degrees.

19. The set of golf clubs of claim 17, wherein:

the center of mass of the first weight is positioned at or proximate to the first distance;

the center of mass of the second weight is positioned at or proximate to the second distance; and the center of mass of the third weight is positioned at or proximate to the third distance.

20. The set of golf clubs of claim 12, wherein:

the first weight is integrated into the first body; and the second weight is integrated into the second body.

21. The set of golf clubs of claim 12, wherein:

the first weight is located at or proximate to the first bottom wall portion; and the second weight is located at or proximate to the second bottom wall portion.

22. The set of golf clubs of claim 12, wherein:

the first weight comprises at least one of: a first elliptical shape, a first circular shape, a first polygonal shape, or a first free-formed shape;

the second weight comprises at least one of: a second elliptical shape, a second circular shape, a second polygonal shape, or a second free-formed shape.

23. The set of golf clubs of claim 12, further comprising:

a third club having a third club head, the third club head having a third toe end, a third heel end, a third front end, a third back end, a third top wall portion, a third bottom wall portion, a third face portion associated with a third loft angle defined by a third loft plane and a third front end plane, the third front end plane is perpendicular to the first ground plane, and a third weight positioned at or proximate to a third distance relative to the third front end plane, at least a portion of the third weight positioned along a third axis extending between the third front end and the third back end, wherein:

the first loft angle and the second loft angle are greater than the third loft angle;

the first distance and the second distance are less than the third distance; and one of the following:

a center of mass of the third weight is positioned at or proximate to the third distance; or an edge of the third weight is positioned at or proximate to the third distance.

24. The set of golf clubs of claim 12, wherein:

the first distance is inversely proportional to the first loft angle in a first linear manner; and the second distance is inversely proportional to the second loft angle in a second linear manner.

* * * * *